US008885854B2

(12) United States Patent
Ko et al.

(10) Patent No.: US 8,885,854 B2
(45) Date of Patent: Nov. 11, 2014

(54) METHOD, MEDIUM, AND SYSTEM DECODING COMPRESSED MULTI-CHANNEL SIGNALS INTO 2-CHANNEL BINAURAL SIGNALS

(75) Inventors: Sangchul Ko, Yongin-si (KR); Junghoe Kim, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1116 days.

(21) Appl. No.: 11/652,687

(22) Filed: Jan. 12, 2007

(65) Prior Publication Data

US 2008/0037795 A1 Feb. 14, 2008

(30) Foreign Application Priority Data

Aug. 9, 2006 (KR) ..... 10-2006-0075301

(51) Int. Cl.
*H04R 5/02* (2006.01)
*H04S 3/00* (2006.01)

(52) U.S. Cl.
CPC ..... *H04S 3/002* (2013.01); *H04S 3/004* (2013.01); *H04S 2420/01* (2013.01)
USPC ..... 381/310

(58) Field of Classification Search
USPC ..... 381/22, 310
See application file for complete search history.

(56) References Cited

U.S. PATENT DOCUMENTS 5,524,054 A 6/1996 Spille
5,850,456 A 12/1998 Tene Kate et al.
7,006,636 B2 2/2006 Baumgarte et al.
7,068,792 B1 6/2006 Surazski et al.
7,487,097 B2 2/2009 Engdegard et al.
7,711,552 B2 5/2010 Villemoes
7,876,904 B2 1/2011 Ojala et al.
7,987,097 B2 7/2011 Pang et al.
2002/0006081 A1 1/2002 Fujishita
2002/0154900 A1 10/2002 Shimada
2003/0026441 A1 2/2003 Faller (Continued)

FOREIGN PATENT DOCUMENTS

JP 11-225390 8/1999
JP 2001-352599 12/2001

(Continued)

OTHER PUBLICATIONS

E. D. Scheirer et al., "AudioBIFS: Describing Audio Scenes with the MPEG-4 Multimedia Standard," IEEE Transactions on Multimedia, Sep. 1999, vol. 1, No. 3, pp. 237-250.

(Continued)

*Primary Examiner* — Duc Nguyen
*Assistant Examiner* — Kile Blair
(74) *Attorney, Agent, or Firm* — Staas & Halsey LLP

(57) ABSTRACT

A decoding method, medium, and system decoding an input compressed multi-channel signal, as a mono or stereo signal, into 2-channel binaural signals. Channel signals making up the multi-channel signals may be reconstructed from the input compressed signal in the quadrature mirror filter (QMF) domain, and head related transfer functions (HRTFs) for localizing channel signals in the frequency domain, represented as values in the time domain, may be transformed into spatial parameters in the QMF domain. Accordingly, channel signals may be localized in the QMF domain in directions corresponding to the channels, thereby decoding the input compressed signal as 2-channel binaural signals.

16 Claims, 5 Drawing Sheets

(56) References Cited

U.S. PATENT DOCUMENTS

| | | | | |
|---|---|---|---|---|
| 2003/0219130 | A1 | 11/2003 | Baumgarte et al. | |
| 2003/0236583 | A1 | 12/2003 | Baumgarte et al. | |
| 2004/0117193 | A1 | 6/2004 | Kawai | |
| 2005/0053249 | A1 | 3/2005 | Wu et al. | |
| 2005/0135643 | A1 | 6/2005 | Lee et al. | |
| 2005/0157883 | A1 | 7/2005 | Herre et al. | |
| 2005/0195981 | A1 | 9/2005 | Faller et al. | |
| 2005/0271213 | A1 | 12/2005 | Kim | |
| 2005/0276420 | A1 | 12/2005 | Davis | |
| 2005/0281408 | A1 | 12/2005 | Kim et al. | |
| 2007/0081597 | A1 | 4/2007 | Disch et al. | |
| 2007/0160218 | A1 | 7/2007 | Jakka et al. | |
| 2007/0189426 | A1 | 8/2007 | Kim et al. | |
| 2008/0008327 | A1 * | 1/2008 | Ojala et al. | 381/20 |

FOREIGN PATENT DOCUMENTS

| | | |
|---|---|---|
| JP | 2004-78183 | 3/2004 |
| JP | 2004-194100 | 7/2004 |
| JP | 2004-312484 | 11/2004 |
| JP | 2005-069274 | 3/2005 |
| JP | 2005-094125 | 4/2005 |
| JP | 2005-098826 | 4/2005 |
| JP | 2005-101905 | 4/2005 |
| KR | 1996-0039668 | 11/1996 |
| KR | 2001-0086976 | 9/2001 |
| KR | 10-2002-0018730 | 3/2002 |
| KR | 10-2002-0082117 | 10/2002 |
| KR | 10-2005-0115801 | 12/2005 |
| KR | 10-2006-0047444 | 5/2006 |
| KR | 10-2006-0049941 | 5/2006 |
| KR | 10-2006-0109299 | 10/2006 |
| KR | 10-2007-0005469 | 1/2007 |
| KR | 10-2007-0035411 | 3/2007 |
| KR | 10-2007-0078398 | 7/2007 |
| KR | 10-2007-0080850 | 8/2007 |
| KR | 10-0763919 | 9/2007 |
| WO | 02/07481 | 1/2002 |
| WO | WO 03/028407 | 4/2003 |
| WO | 2004/008805 | 1/2004 |
| WO | 2004/019656 | 3/2004 |
| WO | 2004-097794 | 11/2004 |
| WO | 2005/036925 | 4/2005 |
| WO | 2005/101370 | 10/2005 |
| WO | 2007/080212 | 7/2007 |

OTHER PUBLICATIONS

Breebart, J. et al. "MPEG Spatial Audio Coding/MPEG Surround: Overview and Current Status" In: Proc. 119th AES Convention, New York, Oct. 2005.

PCT International Search Report issued Jun. 12, 2007 in corresponding Korean PCT Patent Application No. PCT/KR2007/001066.

PCT International Search Report issued Apr. 12, 2007 in corresponding Korean PCT Patent Application No. PCT/KR2007/000201.

PCT International Search Report issued Jun. 14, 2007 in corresponding Korean PCT Patent Application No. PCT/KR2007/001067.

ISO/IEC JTC 1/SC 29/WG 11 N7983, "Coding of Moving Pictures and Audio", Apr. 2006, Montreux.

Breebaart Jeroen, et al. "The Reference Model Architecture fore MPEG Spatial Audio Coding", AES Convention 118 May 2005, AES, 60 East 42nd Street, Room 2520 New York.

Japanese Final Rejection mailed Jul. 24, 2012 in Japanese Application No. 2008-550238.

Korean Notice of Allowance dated Sep. 28, 2012 in Korean Application No. 10-2012-0083520.

Korean Office Action dated Aug. 14, 2012 in Korean Application No. 10-2011-0056345.

Korean Notice of Allowance dated Sep. 28, 2012 in Korean Application No. 10-2006-0049034.

European Search report dated Sep. 10, 2012 in European Application No. 12002670.3-2225.

European Search report issued on Jul. 16, 2012 in European Patent Application No. 12170289.8-2225.

European Search report issued on Jul. 16, 2012 in European Patent Application No. 12170294.8-2225.

J. Herre et al., The Reference Model Architecture for MPEG Spatial Audio Coding, Audio Engineering Society Convention Paper 6447, USA, Audio Engineering Society, 28, May 2005.

ISO/IEC JTC1/SC29/WG 11 MPEG2005/M12886, "Coding of Moving Pictures and Audio", Jan. 2006, Bangkok, Thailand.

ISO/IEC JTC 1/SC 29/WG 11 N7530 "Coding of Moving Pictures and Audio", Oct. 2005, Nice, France.

Extended European Search Report dated Feb. 5, 2010 related to European Application No. 07715470.6-2225.

Japanese Office Action issued Jun. 7, 2011 related to Japanese Patent Application No. 2008-550238.

Japanese Office Action dated Feb. 15, 2011 related to Chinese Patent Application No. 2008-550237.

Advisory Action mailed Nov. 28, 2012 in co-pending U.S. Appl. No. 11/707,990.

U.S. Office Action mailed Sep. 10, 2012 in co-pending U.S. Appl. No. 11/707,990.

Korean Notice of Allowance issued Sep. 20, 2007 related to Korean Patent Application No. 10-2006-0109523.

Korean Non-Final Rejection mailed Jun. 27, 2012 related to Korean Patent Application No. 10-2012-0064601.

Korean Non-Final Rejection mailed Apr. 30, 2012 related to Korean Patent Application No. 10-2006-0049034.

Korean Notice of Allowance mailed Jul. 26, 2011 related to Korean Patent Application No. 10-2007-0067134.

Korean Non-Final Rejection dated Dec. 3, 2012 in Korean Application No. 10-2012-0108275.

Advisory Action mailed Nov. 28, 2012 in related U.S. Appl. No. 11/707,990.

Extended European Search Report dated Dec. 3, 2012 in European Patent Application No. 12164460.3-2225.

Notice of Allowance issued Aug. 29, 2007 in Korean Application No. 10-2006-0075301.

Notice of Last Non-Final Rejection issued Feb. 27, 2013 in Korean Application No. 10-2012-0064601.

Notice of Preliminary Reexamination dated Feb. 19, 2013 in Japanese Application No. 2008-550238.

Korean Office Action dated Jul. 30, 2013 in Korean Patent Application No. 10-2012-0108275.

Korean Office Action dated Jul. 30, 2013 in Korean Patent Application No. 10-2012-0064601.

US Office Action issued Aug. 15, 2013 in copending U.S. Appl. No. 11/652,031.

US Office Action mailed Mar. 2, 2011 in copending U.S. Appl. No. 11/707,990.

US Office Action mailed Dec. 19, 2011 in copending U.S. Appl. No. 11/707,990.

US Office Action mailed Apr. 11, 2012 in copending U.S. Appl. No. 11/652,031.

US Office Action mailed Mar. 17, 2011 in copending U.S. Appl. No. 11/652,031.

US Office Action mailed Nov. 1, 2011 in copending U.S. Appl. No. 11/652,031.

Korean Office Action dated Jul. 18, 2011 issued in related Korean Patent Application No. 10-2011-0056345.

Extended European Search Report issued by the European Patent Office on Jan. 7, 2010 in correspondence to European Patent Application No. 07708487.9.

Korean Office Action issued Oct. 24, 2013 in Korean Patent Application No. 10-2012-0108275.

Korean Office Action issued Oct. 24, 2013 in Korean Patent Application No. 10-2012-0064601.

Japanese Office Action issued Jun. 11, 2013 in Japanese Patent Application No. 2012-253715.

US Notice of Allowance issued Aug. 26, 2013 in copending U.S. Appl. No. 11/707,990.

US Office Action issued Apr. 7, 2014 in U.S. Appl. No. 11/652,031.

* cited by examiner

METHOD, MEDIUM, AND SYSTEM DECODING COMPRESSED MULTI-CHANNEL SIGNALS INTO 2-CHANNEL BINAURAL SIGNALS

CROSS-REFERENCE TO RELATED APPLICATIONS

This application claims the benefit of Korean Patent Application No. 10-2006-0075301, filed on Aug. 9, 2006, in the Korean Intellectual Property Office, the disclosure of which is incorporated herein in its entirety by reference.

BACKGROUND OF THE INVENTION

1. Field of the Invention

One or more embodiments of the present invention relate to audio decoding, and more particularly, in an embodiment, to moving picture experts group (MPEG) surround audio decoding capable of decoding binaural signals from encoded multi-channel signals using sound localization.

2. Description of the Related Art

In conventional signal processing techniques for generating binaural sounds from encoded multi-channel signals, an operation of reconstructing the multi-channel signals from the input encoded signal is performed first, followed by an operation of transforming the multi-channel signal into the frequency domain and separately up-mixing each reconstructed multi-channel signal to 2-channel signals for output by binaural processing using head related transfer functions (HRTFs). These two operations are separately performed, and are also complex, resulting in it being difficult to generate signals in devices having limited hardware resources, such as mobile audio devices.

Here, the encoded multi-channel signals are obtained by an encoder compressing the original multi-channel signals into a corresponding encoded mono or stereo signal by using respective spatial cues for the different multi-channel signals, and corresponding spatial cues are used by the decoder to decode the encoded mono or stereo signal into the decoded multi-channel signals. This encoding from the multi-channel signals to the encoded mono or stereo signal using respective spatial cues is considered a "down-mixing" of the multi-channel signals, as the different signals are mixed together to generate the encoded mono or stereo signal. This down-mixing is performed in a series of staged down-mixing modules, with corresponding spatial cues being used at each down-mixing module. Similarly, in the decoding side, a received encoded mono or stereo signal can be separated or un-mixed into respective multi-channel signals. This un-mixing is considered an "up-mixing", and is accomplished through a series of staged up-mixing modules that up-mix the signals using respective spatial cues to eventually output the resultant decoded multi-channel signals. As noted, above, when generating binaural sounds from these decoded multi-channel signals, an additional operation is performed using the aforementioned HRTFs.

As an example, FIG. 1 illustrates such a conventional operation for generating 2-channel binaural signals from decoded multi-channel signals.

Here, in order to output multi-channel signals as 2-channel binaural signals, such operations will now be briefly explained with a system of the illustrated multi-channel encoder 102, multi-channel decoder 104, and binaural processing device 106.

Thus, in this representative example, the multi-channel encoder 102 compresses the input multi-channel signals into a mono or stereo signal, i.e., through the above mentioned staged down-mixing modules, and then, the multi-channel decoder 104 may receive the resultant mono or stereo signal as an input signal. The multi-channel decoder 104 reconstructs multi-channel signals from the input signal by using the aforementioned spatial cues in a quadrature mirror filter (QMF) domain and then transforms resultant reconstructed multi-channel signals into time-domain signals. The QMF domain represents a domain including signals obtained by dividing time-domain signals according to frequency bands. The binaural processing device 106 then transform the decoded multi-channel signals transformed into the time-domain signals into frequency-domain multi-channel signals, and then up-mixes the transformed multi-channel signals to 2-channel binaural signals using HRTFs. Thereafter, the up-mixed 2-channel binaural signals are respectively transformed into time-domain signals. As described above, in order to output an encoded input signal as the 2-channel binaural signals, the separate sequential operations of reconstructing the multi-channel signals from the input signal in the multi-channel decoder 104, and transforming the multi-channel signal into the frequency domain and separately up-mixes each reconstructed multi-channel signal into the 2-channel binaural signals are required. Here, these operations are separate because they must be performed in separate domains.

However, as noted above, in such conventional systems, there are problems in that, firstly, due to the required two processing operations, decoding complexity is increased. Secondly, since the binaural processing device 106 must additionally operate in the frequency domain, the transforming of the reconstructed multi-channel signals into the frequency-domain is required. Lastly, in order to further up-mix the reconstructed multi-channel signals to generate the two binaural channels, through binaural processing, typically a designated chip for performing such a binaural processing device is required.

SUMMARY OF THE INVENTION

One or more embodiments of the present invention provides a decoding method, medium, and system decoding multi-channel signals into 2-channel binaural signals, capable of reconstructing multi-channel signals from an encoded input signal, in the quadrature mirror filter (QMF) domain, transforming head related transfer function (HRTF) used for localizing the signals in the frequency domain, represented as values in the time domain, into spatial parameters in the QMF domain, localizing the reconstructed multi-channel signals in the QMF domain in directions corresponding to the respective channels by using the transformed spatial parameters, thereby generating binaural signals using simple operations without deterioration.

Additional aspects and/or advantages of the invention will be set forth in part in the description which follows and, in part, will be apparent from the description, or may be learned by practice of the invention.

To achieve the above and/or other aspects and advantages, embodiments of the present invention may include a decoding method for decoding at least one input multi-channel compressed signal into 2-channel binaural signals, the method including reconstructing multi-channel signals from the compressed signal in a quadrature mirror filter (QMF) domain, transforming head related transfer functions (HRTFs), used for localizing channel signals in a frequency domain and represented as values in a time domain, into spatial parameters in the QMF domain, and localizing the reconstructed multi-channel signals in the QMF domain in directions corresponding to respective channels using the transformed spatial parameters.

To achieve the above and/or other aspects and advantages, embodiments of the present invention may include at least one medium including computer readable code to control at least one processing element to implement an embodiment of the present invention.

To achieve the above and/or other aspects and advantages, embodiments of the present invention may include a decoding system for decoding an input multi-channel compressed signal into 2-channel binaural signals, the system including a multi-channel synthesizer to reconstruct multi-channel signals from the compressed signal in a QMF domain, a filter transformer to transform HRTFs, used for localizing channel signals in a frequency domain and represented as values in a time domain, into spatial parameters in the QMF domain, and a binaural synthesizer to localize the reconstructed multi-channel signals in the QMF domain in directions corresponding to respective channels using the transformed spatial parameters.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE PREFERRED EMBODIMENTS

Figure 1:
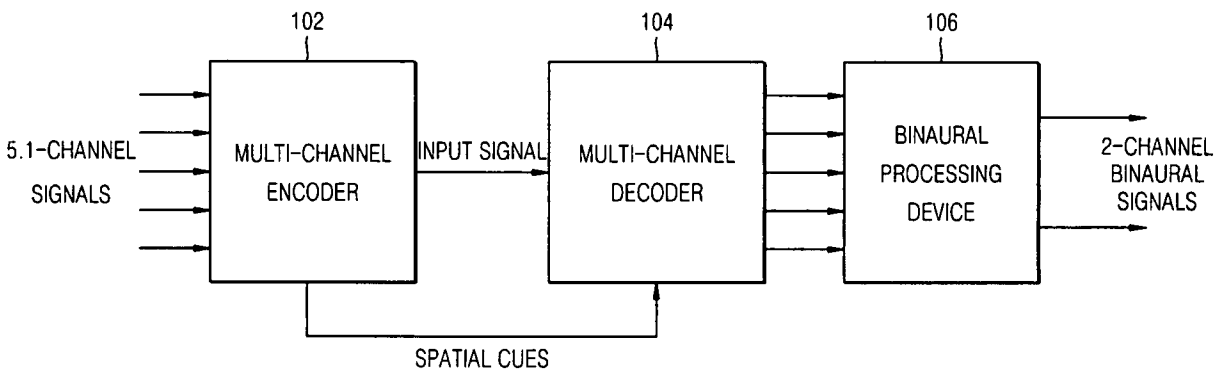
FIG. 1 (PRIOR ART)
FIG. 1 illustrates a conventional multi-channel encoding/decoding system outputting a 2-channel binaural signal.

Reference will now be made in detail to embodiments of the present invention, examples of which are illustrated in the accompanying drawings, wherein like reference numerals refer to the like elements throughout. Embodiments are described below to explain the present invention by referring to the figures.

Figure 2:
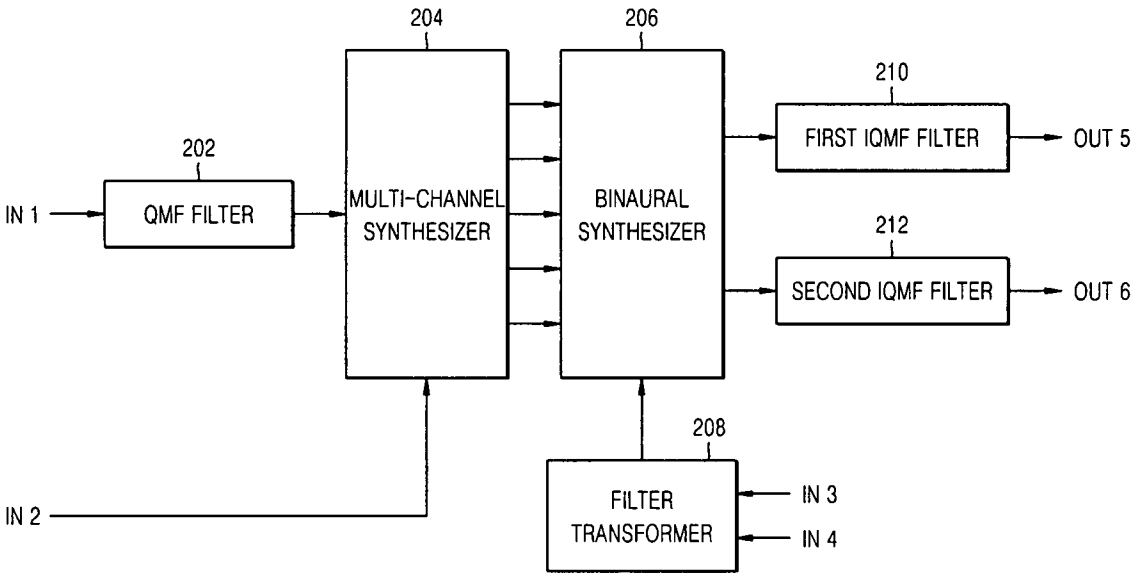
FIG. 2 illustrates a decoding system decoding compressed multi-channel signals as 2-channel binaural signals, according to an embodiment of the present invention.

FIG. 2 illustrates a decoding system decoding a compressed multi-channel signal, as a mono or stereo signal, into 2-channel binaural signals, according to an embodiment of the present invention.

Here, the decoding system may include a quadrature mirror filter (QMF) 202, a multi-channel synthesizer 204, a binaural synthesizer 206, a filter transformer 208, a first inverse quadrature mirror filter (IQMF) 210, and a second IQMF 212, for example.

The QMF 202 may receive the compressed multi-channel signal, as the mono or stereo signal, e.g., from a multi-channel encoder (not shown), through an input terminal IN 1, and may then transform the mono or stereo signal into the QMF-domain.

The multi-channel synthesizer 204 may then receive spatial cues, e.g., generated during a down-mixing of the original multi-channel signals by staged down-mixing modules of a multi-channel encoder (not shown) into the mono or stereo signal, through an input terminal IN 2. The multi-channel synthesizer 204, thus, up-mixes the QMF domain mono or stereo signal using the spatial cues. Therefore, the multi-channel synthesizer 204 may output the up-mixed left front channel signal, right front channel signal, center front channel signal, left surround channel signal, right surround channel signal, and low frequency effect channel signal (not shown).

Here, the filter transformer 208 may receive head related transfer functions (HRTFs), e.g., through an input terminal IN 3 and an input terminal IN 4, and transform the received HRTFs into QMF domain spatial parameters usable by the binaural synthesizer 206 in the QMF domain.

Figure 3:
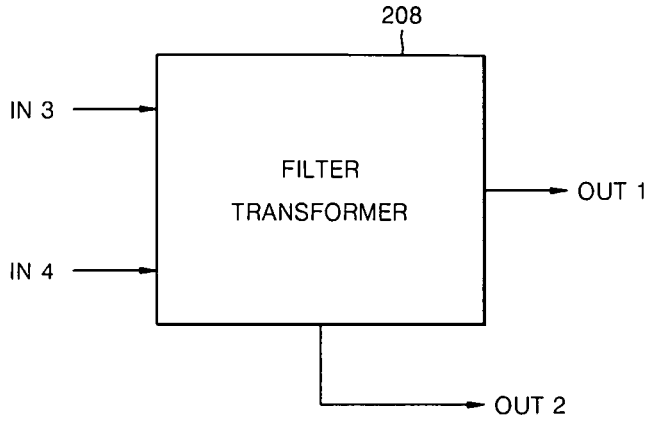
FIG. 3 illustrates a filter transformer, such as that shown in FIG. 2, according to an embodiment of the present invention.

FIG. 3 illustrates a filter transformer 208, such as that shown in FIG. 2, according to an embodiment of the present invention.

Such operations for transforming the HRTF, represented as values in the time domain, into spatial parameters in the QMF domain by the filter transformer 208 will now be described in greater detail In general, the HRTFs used for localizing channel signals making up multi-channel signals are applied in the frequency domain. However, in an embodiment of the present invention, the HRTFs used for localizing channel signals making up the multi-channel signals are used in the QMF domain. Therefore, an operation of transforming the HRTFs for use in the QMF domain is needed.

The filter transformer 208 receives corresponding HRTFs in a direction close to a direction of a sound source (at an acute angle) represented as values in the time domain, e.g., through the input terminal IN 3, and receives corresponding HRTFs in a direction far from a direction of the sound source (at an obtuse angle) represented as values in the time domain, e.g., through the input terminal IN 4. Here, the HRTF is a transfer function used for localizing channel signals in the frequency domain. The HRTF is generated by performing frequency transformation on a head-related impulse response (HRIR) measured from the sound source at the left or right eardrum in the time domain. Therefore, according to an embodiment of the present invention, the HRIRs representing the HRTF in the time domain are input through the input terminal IN 3 and the input terminal IN 4. Along with the HRIR, important information of the HRTF representing a sonic process of transferring a sound source localized in free space to a person's ears includes an inter-aural time difference (ITD) and an inter-aural level difference (ILD), which represent corresponding spatial properties. Thus, the ITD and the ILD, as parameters showing properties of the HRTF in the time domain, may be input through the input terminal IN 3 and the input terminal IN 4.

In an embodiment, the filter transformer 208 may be constructed with a one-to-two (OTT) module, for example. Thus, the filter transformer 208 may generate a signal synthesized by down-mixing input signals based on spatial parameters according to a general property of the OTT module. Such an OTT module may, thus, be used for performing binaural cue coding (BCC). Generally, during an encoding operation, when two signals in the time domain are received by an OTT module, the OTT module can output spatial parameters for subsequent reconstructing of the input two signals and a synthesized time-domain signal. Alternatively, during the decoding operation, the OTT module may receive the corresponding compressed time-domain signal and spatial parameters for reconstructing the compressed time-domain signal in order to output two reconstructed signals in the time domain. More specifically, the filter transformer 208 may output HRTFs synthesized by down-mixing the received first and second parameters, e.g., through an output terminal OUT 1. Further, the filter transformer 208 may output corresponding channel level differences (CLDs) and inter-channel correlations (ICCs), which are spatial parameters used in the QMF domain, through an output terminal OUT 2. Here, the output CLDs and the ICCs are transformed values which the filter transformer 208 receives the HRTFs used for localizing the channel signals represented as values in the time domain and transforms them to values which perform sound localization in the QMF domain. Therefore, the CLDs and the ICCs may be used as spatial parameters for localizing signals between channels in the QMF domain. Returning to FIG. 2, the binaural synthesizer 206 may down-mix the example left front channel signal, right front channel signal, center front channel signal, left surround channel signal, and right surround channel signal, from the multi-channel synthesizer 204, to 2-channel signals using the CLDs and the ICCs input from the filter transformer 208.

Figure 4:
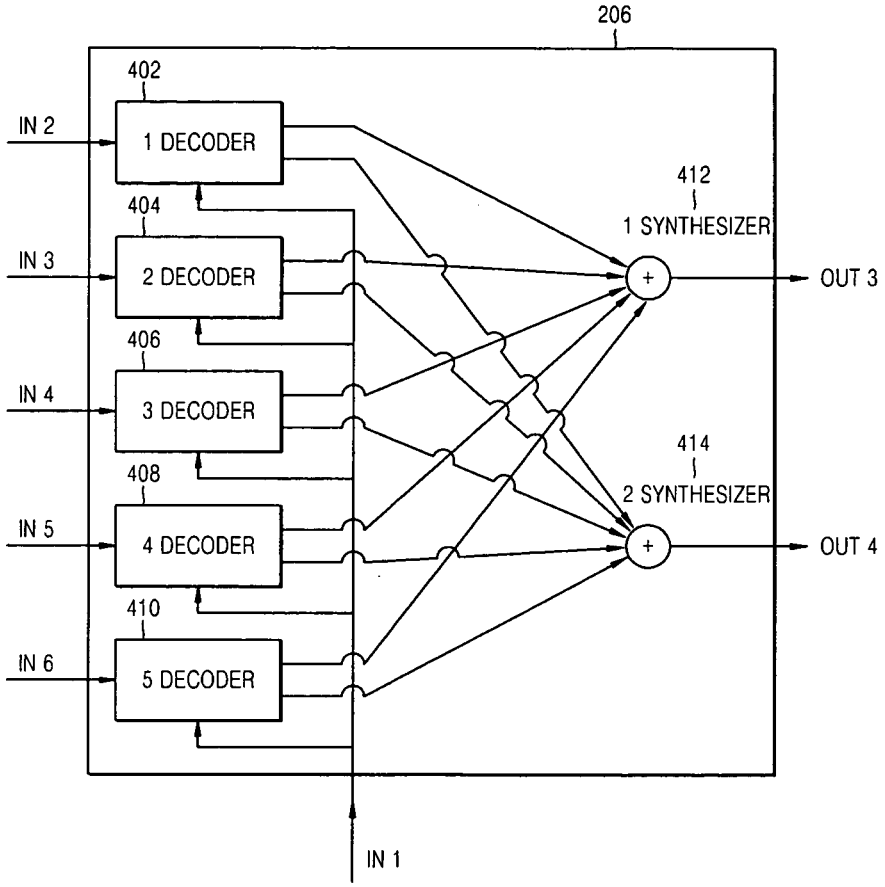
FIG. 4 illustrates a binaural synthesizer, such as that shown in FIG. 2, according to an embodiment of the present invention.

FIG. 4 illustrates a binaural synthesizer 206, such as that shown in FIG. 2, according to an embodiment of the present invention.

Here, operations for synthesizing channel signals input to the binaural synthesizer 206 to 2-channel binaural signals will now be described in greater detail.

The binaural synthesizer 206 may include first, second, third, fourth, and fifth decoders 402, 404, 406, 408, and 410, and first and second synthesizers 412 and 414, for example.

The first to fifth decoders 402 to 410 use the aforementioned OTT modules, with different multi-channel signals being input to the decoders 402 to 410. The first and second synthesizers 412 and 414 then separately synthesize signals as single signals.

First, operations of the up-mixing of an input signal of the first decoder 402 will be described.

Thus, the first decoder 402 receives the example left front channel signal through the input terminal IN 2 and spatial parameters, e.g., output from the output terminal OUT 2 of the filter transformer 208, through an input terminal IN 1. In this case, the spatial parameter refers to a corresponding CLD and ICC obtained in the filter transformer 208. In this embodiment, the first decoder 402 is thus a binaural cue coding decoder and uses the general property of the OTT module, so that the first decoder 402 up-mixes the left front signal for 2-channel binaural signals using the corresponding CLD and ICC. More specifically, after the first decoder 402 divides the input left front signal into a left component signal and a right component signal, the divided left component signal is output to the first synthesizer 412, and the divided right component signal is output to the second synthesizer 414. The second decoder 404 similarly receives the right front signal, e.g., through an input terminal IN 3, and by performing similar operations as those of the first decoder 402, a left component signal and a right component signal, obtained by up-mixing the input right front signal, are output to the first and second synthesizers 412 and 414, respectively. By performing similar operations as those of the first decoder 402, the third, fourth, and fifth decoders 406, 408, and 410 also similarly divide the input center front channel signal, the left surround channel signal, and the right surround channel signal into left component signals and right component signals so as to be output to the first and second synthesizers 412 and 414. In addition, as the low frequency effect channel signal (not shown) does not have directionality, the low frequency effect channel signal may be added to the first and second synthesizers 412 and 414 without performing decoding operations.

The first synthesizer 412 may then synthesize all input signals, e.g., so as to be output through an output terminal OUT 3. In other words, the generated left components channel signal is synthesized and output through the output terminal OUT 3.

The second synthesizer 414 further synthesizes all input signals, e.g., so as to be output through an output terminal OUT 4. In other words, the generated right component channel signal is synthesized and output through the output terminal OUT 4.

Returning to FIG. 2, the first IQMF 210 may receive the synthesized left components channel signal, and transform the received signal into a time-domain signal and outputs the same through output terminal OUT 5.

The second IQMF 212 may receive the synthesized right components channel signal, and transforms the received signal into a time-domain signal and outputs the same through an output terminal OUT 6.

Figure 5:
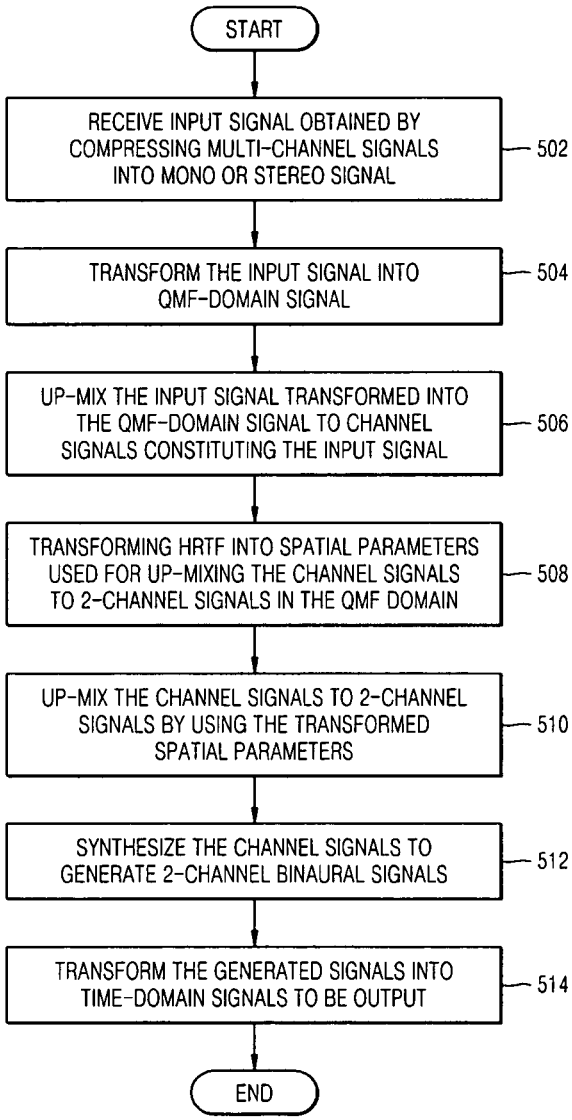
FIG. 5 illustrates decoding operations for decoding compressed multi-channel signals as 2-channel binaural signals, according to an embodiment of the present invention.

FIG. 5 illustrates decoding operations for decoding an input signal, obtained by compressing multi-channel signals into a mono or stereo signal, into 2-channel binaural signals according to an embodiment of the present invention.

Operations for decoding an input compressed multi-channel signal, as a mono or stereo signal, into 2-channel binaural signals will now be described.

In operation 502, the input compressed signal may be received, e.g., by the QMF 202. In operation 504 the received input signal may be transformed into a QMF-domain signal, e.g., again by the QMF 202. Here, the example input compressed signal is a time-domain signal, but in order to output 2-channel binaural signals through synthesizing the corresponding encoded multi-channel signals, operations for transforming the input signal into the QMF-domain signal may, thus, be needed.

In operation 506, the transformed QMF-domain signal may be up-mixed, e.g., by the multi-channel synthesizer 204, to respective multi-channel signals. In this case, as an example, a left front channel signal, right front channel signal, center front channel signal, left surround channel signal, right surround channel signal, low frequency effect channel signal, or the like may be decoded.

In operation 508, in order to up-mix the respective multi-channel signals to the 2-channel signals, in the QMF domain, needed spatial cues may be extracted from the HRTF in the time domain, e.g., by the filter transformer 208. As noted above, as the filter transformer 208 uses OTT modules, the input signal may have to be a signal transformed into the QMF-domain. Therefore, a HRIR transformed into the QMF domain is used as an input HRTF. In this case, respective CLDs and ICCs may be extracted from the input HRIR.

In operation 510, the respective multi-channel signals may be up-mixed to the 2-channel signals by using the respective CLDs and the ICCs, e.g., by the binaural synthesizer 206. More specifically, as an example, the multi-channel synthesizer 204 may up-mix the left front channel signal, the right front channel signal, the center front channel signal, the left surround channel signal, and the right surround channel signal to 2-channel signals, respectively, by using the respective CLDs and ICCs. In one embodiment, as the low frequency effect channel signal does not have directionality, such operations may not be performed on the low frequency effect channel signal.

In operation 512, the 2-channel binaural signals may be generated by synthesizing the respective channel signals into the 2-channel signals. More specifically, by performing operation 510, the respective channel signals are up-mixed as left and right component signals, with the left component signal being synthesized from the respective channels and the right component signal being synthesized from the respective channels, thereby generating the 2-channel binaural signals.

In operation 514, the generated signals are then transformed into time-domain signals. Here, as the resultant 2-channel binaural signals generated in operation 512 may be in the QMF-domain, operations for transforming the generated signals into time domain signals may then be implemented.

According to a decoding method, medium, and system decoding an input compressed multi-channel signal, as a mono or stereo signal, into 2-channel binaural signals, of an embodiment of the present invention, an operation of reconstructing multi-channel signals from the input compressed signal and a binaural processing operation of outputting 2-channel binaural signals may be performed simultaneously. Therefore, decoding is simple. Further, such binaural processing operation can be performed in the QMF domain. Therefore, secondary operations of transforming decoded multi-channel signals into the frequency-domain for application of HRTF parameters in the frequency domain, as in the conventional binaural process, are not needed. Lastly, operation of reconstructing multi-channel signals from an input signal and a binaural processing operation can be performed by one device, such that additional designated chips for the operation of such binaural processing is not required. Therefore, spatial audio can be reproduced by using a small amount of hardware resources.

Accordingly, as an example, spatial audio can be reproduced by a mobile audio system/device with limited hardware resources and without deterioration. In addition, a desktop video (DTV) having a greater amount of hardware resources than the mobile audio device can still reproduce high-quality audio using previously allocated hardware resources, if selectively desired.

In addition to the above described embodiments, embodiments of the present invention can also be implemented through computer readable code/instructions in/on a medium, e.g., a computer readable medium, to control at least one processing element to implement any above described embodiment. The medium can correspond to any medium/media permitting the storing and/or transmission of the computer readable code.

The computer readable code can be recorded/transferred on a medium in a variety of ways, with examples of the medium including magnetic storage media (e.g., ROM, floppy disks, hard disks, etc.), optical recording media (e.g., CD-ROMs, or DVDs), and storage/transmission media such as carrier waves, as well as through the Internet, for example. Here, the medium may further be a signal, such as a resultant signal or bitstream, according to embodiments of the present invention. The media may also be a distributed network, so that the computer readable code is stored/transferred and executed in a distributed fashion. Still further, as only an example, the processing element could include a processor or a computer processor, and processing elements may be distributed and/or included in a single device.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A decoding method for decoding at least one input multi-channel compressed signal into 2-channel binaural signals, the method comprising:

reconstructing multi-channel signals from the compressed signal, by using first spatial parameters, in a quadrature mirror filter (QMF) domain;

transforming head related transfer functions (HRTFs), used for localizing channel signals in a frequency domain and represented as values in a time domain, into second spatial parameters in the QMF domain;

localizing the reconstructed multi-channel signals in the QMF domain in directions corresponding to respective channels using the transformed second spatial parameters; and generating at least one binaural signal based on respective channel components of the localized multi-channel signals in the QMF domain.

2. The method of claim 1, wherein the second spatial parameters in the QMF domain include at least one of a channel level difference (CLD) and an inter-channel correlation (ICC).

3. The method of claim 2, wherein, in the localizing of the channel signals, by using CLDs and ICCs, the respective channel signals are localized in directions corresponding to the respective channel signals and then divided into left and right component signals in the QMF domain, with the divided left and right component signals being synthesized to generate left and right components of the respective binaural signal.

4. The method of claim 1, wherein the values representing the HRTFs in the time domain are an inter-aural level difference (ILD) parameter and an inter-aural time difference (ITD) parameter.

5. The method of claim 1, wherein the values representing the HRTFs in the time domain are head related impulse responses (HRIRs).

6. The method of claim 1, wherein, in the transforming of the HRTFs, at least two input values representing the HRTFs in the time domain are down-mixed to generate one synthesized value, with spatial cues corresponding to the synthesized value being generated, thereby transforming the at least two input values into the second spatial parameters corresponding to the generated spatial cues.

7. At least one non-transitory medium comprising computer readable code to control at least one processing element to implement the method of claim 1.

8. A decoding system for decoding an input multi-channel compressed signal into 2-channel binaural signals, the system comprising:

a multi-channel synthesizer to reconstruct multi-channel signals from the compressed signal, by using first spatial parameters, in a quadrature mirror filter QMF domain;

a filter transformer to transform HRTFs, used for localizing channel signals in a frequency domain and represented as values in a time domain, into second spatial parameters in the QMF domain; and a binaural synthesizer to localize the reconstructed multi-channel signals in the QMF domain in directions corresponding to respective channels using the transformed second spatial parameters, wherein the binaural synthesizer generates at least one binaural signal based on respective channel components of the localized multi-channel signals in the QMF domain.

9. The system of claim 8, wherein the second spatial parameters in the QMF domain include at least one of a channel level difference (CLD) and an inter-channel correlation (ICC).

10. The system of claim 9, wherein the binaural synthesizer comprises:

a decoder to localize respective channel signals in directions corresponding to the respective channel signals and then divide respective localized channel signals into left and right component signals in the QMF domain by using CLDs and ICCs;

a first synthesizer to synthesize the divided left component signals; and a second synthesizer to synthesize the divided right component signals.

11. The system of claim 8, wherein the values representing the HRTFs in the time domain are an inter-aural level difference (ILD) parameter and an inter-aural time difference (ITD) parameter.

12. The system of claim 8, wherein the values representing the HRTFs in the time domain are head related impulse responses (HRIRs).

13. The system of claim 8, wherein the filter transformer down-mixes at least two input values representing the HRTFs in the time domain in order to generate one synthesized value and generates spatial cues corresponding to the synthesized value, thereby transforming the at least two input values into the second spatial parameters corresponding to the generated spatial cues.

14. The system of claim 8, wherein the system is incorporated in one device, including one of at least a mobile audio device or desktop video device.

15. The system of claim 14, wherein, when the device is a desktop video device, the reconstructed multi-channel signals are selectively output instead of the binaural signals.

16. A decoding method for decoding at least one input multi-channel compressed signal into 2-channel binaural signals, the method comprising:

reconstructing multi-channel signals from the at least one input multi-channel compressed signal using first spatial parameters, in a quadrature mirror filter QMF domain;

respectively localizing one or more of the reconstructed multi-channel signals in directions corresponding to respective channels, by up-mixing each of the one or more of the reconstructed multi-channel signals using respective second spatial parameters, in the QMF domain; and generating at least one binaural signal based on respective channel components of the localized multi-channel signals in the QMF domain, wherein the respective second spatial parameters are head related transfer function (HRTF) parameters in the QMF domain.

* * * * *